United States Patent [19]

Samansky

[11] Patent Number: 4,527,800

[45] Date of Patent: Jul. 9, 1985

[54] FOLDABLE BOARD GAME WITH TRIANGULAR AND TRAPAZOIDAL AREAS

[76] Inventor: Terry Samansky, 752½ W. 10th St., San Pedro, Calif. 90731

[21] Appl. No.: 529,210

[22] Filed: Sep. 6, 1983

[51] Int. Cl.[3] ..... A63F 3/00

[52] U.S. Cl. ..... 273/261; 273/285; 273/287; 273/288

[58] Field of Search ..... 273/285, 261, 260, 287, 273/242, 263, 264, 288; 229/22, 41 R, 41 D; D21/15, 24, 33

[56] References Cited

U.S. PATENT DOCUMENTS

| | | | |
|---|---|---|---|
| D. 224,548 | 8/1972 | Tyler | 273/261 X |
| 2,936,939 | 5/1960 | Lundquist | 229/8 |
| 3,887,190 | 6/1975 | Ameri | 273/264 |
| 3,929,337 | 12/1975 | Hayes | 273/260 |
| 4,140,317 | 2/1979 | Ramney | 273/287 X |
| 4,213,615 | 7/1980 | Price | 273/260 |

FOREIGN PATENT DOCUMENTS

| | | | |
|---|---|---|---|
| 355396 | 8/1961 | Switzerland | 229/22 |

OTHER PUBLICATIONS

Frank Brady, "The $100,000 Gambit", *Game Magazine,* Jan.-Feb. 1981, pp. 18-20.

*Primary Examiner*—Richard C. Pinkham
*Assistant Examiner*—Scott L. Brown
*Attorney, Agent, or Firm*—James E. Brunton

[57] ABSTRACT

A board game using playing pieces in the shape of regular tetrahedrons, each face being an equilateral triangle with surface markings, such as dots, whose numbers range from one to four, distinguishing it from the other three faces. The fifteen regular tetrahedral playing pieces form three groups of five identical pieces each, each group being a different color. The game also uses a game board consisting of seven separate panels; four triangular and three trapazoidal. Each panel is divided into smaller equilateral triangular areas which are equal in size and shape to the faces of the playing pieces. The panels are connected with a flexible material whereby the game board can be folded into a regular tetrahedral shaped box to serve as the container for the playing pieces.

6 Claims, 22 Drawing Figures

FOLDABLE BOARD GAME WITH TRIANGULAR AND TRAPAZOIDAL AREAS

BACKGROUND OF THE INVENTION

1. Field of the Invention

The invention relates generally to a board game and, more particularly, to a game played with playing pieces having the shape of regular tetrahedrons. The game board of the invention is provided with a multiplicity of marked subdivisions in the shape of equilateral triangles which correspond to the triangular faces of the playing pieces. The game board is foldable to provide a container for the game pieces.

2. Discussion of the Prior Art

Numerous types of board games have been devised in the past. Many, such as chess, checkers and backgammon, have survived for many, many years. Typically, prior art board games involve the use of game pieces of distinctive shape or color which are moved along a game board which is marked off into defined segments or areas. When not in use, the game board is usually folded and, along with the game pieces, is stored in a separate box or container.

The game of the present invention is in the mold of the perennially popular board games such as chess and checkers and involves the application of considerable forethought, planning and strategy.

Besides providing a challenging new strategic game of the same order as checkers, chess and backgammon, the invention also provides its own unique game package. By designing the game board so that it can be folded into a tetrahedral shaped box, the need for a separate package or reusable carton has been eliminated. Furthermore, the distinctive shape of the box, which is also that of the playing pieces, provides an attractive, durable and powerful marketing tool.

SUMMARY OF THE INVENTION

The present invention is an innovative approach to strategic board games. The game can be played by two or three persons and is played on a game board which also serves as the game package. The game board is divided into sixty small equilateral triangular areas identical in size and shape. The game is played with fifteen regular tetrahedron shaped playing pieces subdivided into three groups of five pieces each, each piece within a group being the same color and each group being a different color. The four faces of the playing pieces are equilateral triangles dimensioned to overlie the small triangular areas of the game board. Each of the four faces of each piece has one of four surface markings differentiating that face from the other three. Except for color, all fifteen pieces are identical. While lying upon the game board only three of the four faces of a playing piece are exposed at any one time. In playing the game, the piece may be moved so as to change not only its position on the game board, but also to change the orientation and exposure of the four faces. While being a simple game to understand and play, this metamorphisis quality of the playing pieces offers a new dimension to the game and allows vast possibilities for challenging strategic play.

It is a primary object of the present invention to provide a novel and highly innovative board game which can be played by persons of varied age groups.

It is another object of the invention to provide a board game of the aforementioned character which is easy to learn, but at the same time, is both entertaining and challenging.

A further object of the invention is to provide a board game as described in the preceding paragraphs which is easily portable.

More particularly it is an important object of the invention to provide a board game in which the uniquely shaped playing board can readily be folded for use as the container for the game pieces during storage or transport of the game.

These and other objects of the invention are achieved by the unique board game described in the following paragraphs.

DESCRIPTION OF ONE FORM OF THE INVENTION

Figure 1:
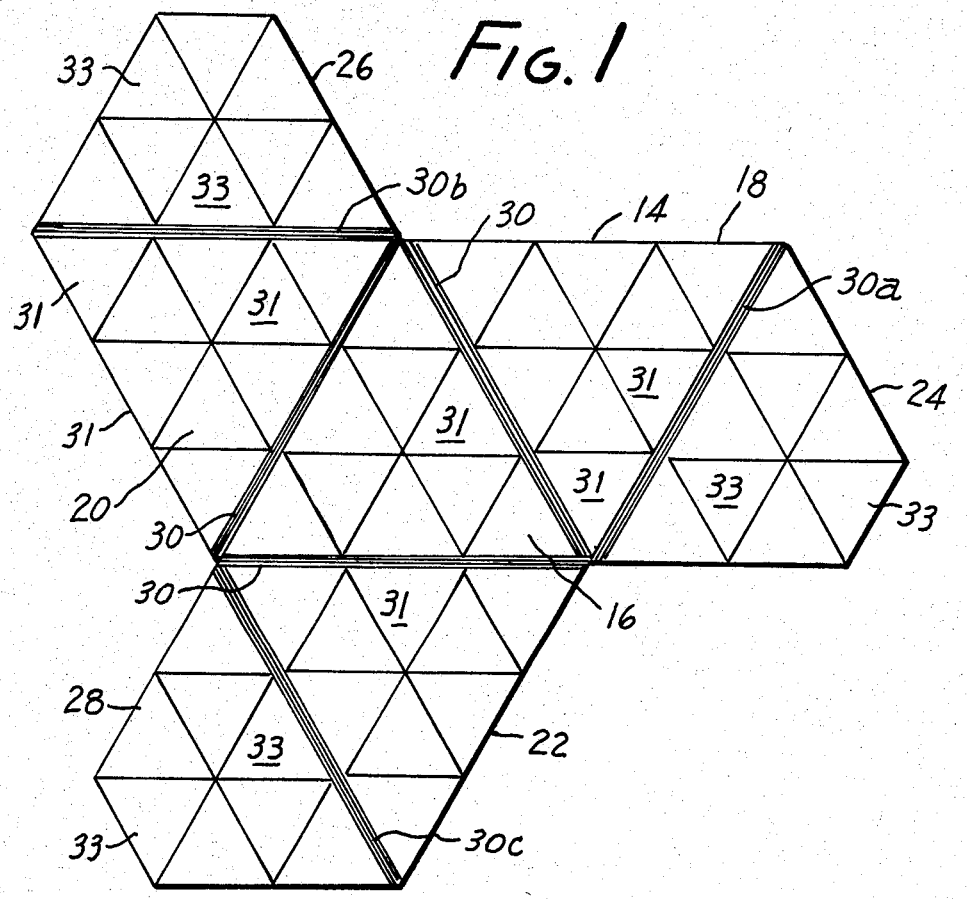
FIG. 1 is a plan view of the game board for playing the game showing the seven foldably interconnected panels of the game board.

Referring to the drawings, and particularly to FIGS. 1 and 2A through 2F, the present invention comprises a board game of the character involving the use of a plurality of separate, uniquely shaped game pieces, generally indicated in the drawings by the numeral 12 (FIGS. 2A through 2F) and a generally planar game board of the irregular shape shown in FIG. 1 and generally designated by the numeral 14. The game board comprises seven separate panels or areas which are interconnected by a connecting means shown here in the form of a flexible tape-like material. The first, second, third and fourth areas, or planar panels, 16, 18, 20 and 22 respectively of the game board are of equal size and each is in the shape of an equilateral triangle. The fifth, sixth and seventh areas, or planar panels, 24, 26 and 28 respectively, are of equal size and are in the shape of a trapezoid.

As illustrated FIG. 1, the second, third and fourth triangularly shaped panels 18, 20 and 22 are hingably interconnected with the first planar panel 16 along the edges thereof by the connecting means or flexible tape designated by the numeral 30. The central panel 16 is thusly enclosed by the panels 18, 20 and 22. The fifth panel 24, which is trapezoidal in shape, is interconnected with second panel 18 along one edge thereof by the connecting means or tape identified in FIG. 1 by the numeral 30*a*. The sixth trapezoidal panel 26 is connected to the third triangularly shaped panel 20 by means of flexible tape designated by the numeral 30*b*. Finally, the seventh trapezoidal shaped panel 28 is interconnected with fourth triangularly shaped panel 22 by flexible tape designated by the numeral 30*c*. With the various panels interconnected in the manner shown in FIG. 1, the game board can be folded from its general planar configuration into a tetrahedral shaped container. The manner of thusly folding the game board is illustrated in FIGS. 3A through 3H and will presently be described.

Each of the triangularly shaped areas 16, 18, 20 and 22 and each of the trapezoidal shaped areas 24, 26 and 28 is divided by line markings into smaller areas. More particularly, in the embodiment of the invention shown in FIG. 1, each of the areas 16, 18, 20 and 22 is divided into nine triangularly shaped smaller areas 31, of equal size and shape. In similar fashion, each of the three trapezoidal shaped areas 24, 26 and 28 is divided by line markings into eight triangularly shaped smaller areas 33 of equal size and shape. As indicated in FIG. 1, smaller areas 31 and 33 are each in the shape of an equilateral triangle.

Figure 2A:
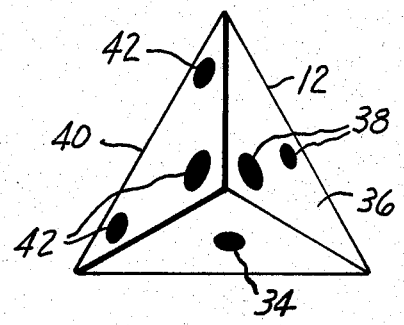
FIG. 2A is a view looking directly down on a game piece of the invention showing three faces thereof.
Figure 2B:
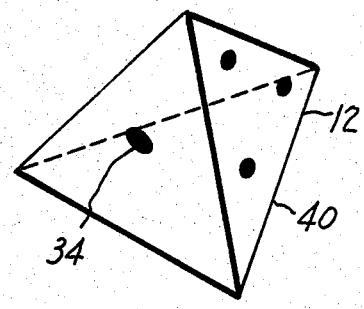
FIG. 2B is a generally perspective view of the game piece shown in FIG. 1.
Figure 2C:
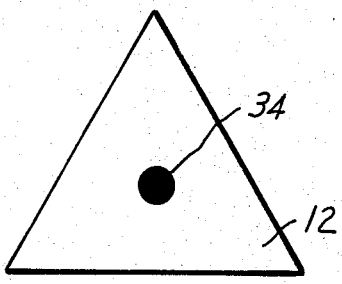
FIGS. 2C through 2F are plan views of each of the four faces of the playing pieces.
Figure 2D:
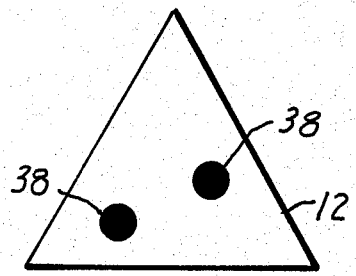
Figure 2E:
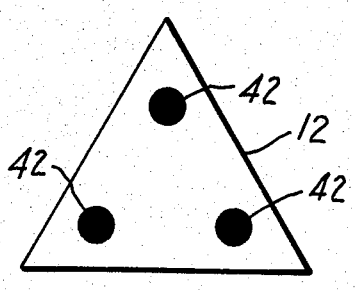
Figure 2F:
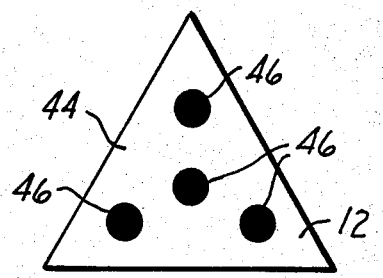

Turning now to FIGS. 2A through 2F, the playing pieces of the instant embodiment of the invention are in the form of tetrahedrons, each having at least one of its four faces provided with distinctive markings. Also, each face of each of the tetrahedral shaped playing pieces 12 is of a size and shape corresponding to the smaller triangularly shaped areas of the game board 31 and 33. Referring particularly to FIGS. 2C through 2F, each face of the tetrahedral playing piece 12 is provided with identifying indicia in the form of one or more dots, as, for example, dot 34 shown in FIG. 2*c*. The second face 36 of the playing piece 12 is provided with two dots 38 (FIGS. 2*a* and 2*d*). The third face 40 of the game piece 12 is provided with three dots 42 and, finally the fourth face 44 of the game piece 12 is provided with 4 dots 46. It is to be understood that the various faces of the game pieces 12 could also be provided with other indicia such as numbers, letters, symbols or combinations thereof.

In playing one form of the board game of the invention using the board shown in FIG. 1 and the game pieces shown in FIGS. 2A through 2F, a total of 15 playing pieces are provided. These 15 playing pieces are divided into three groups of five pieces each. Each piece in a single group is of the same color, while each group comprising five different pieces is of a different color from that of the other two groups. For example, the five pieces in the first group might all be red. The five pieces in the second group might all be blue, while the five pieces in the third group might all be yellow. The choice of colors used is arbitrary and only functions to differentiate the pieces in one group from the pieces in another group. In the form of the invention shown in the drawings, each of the pieces in each of the groups is provided with triangularly shaped faces having indicia thereon of the character illustrated in FIGS. 2A through 2F.

By way of illustration, one of the possible games that can be played by either two or three persons with the game board and game pieces shown in FIGS. 1 and 2A through 2F is played as follows: Each player begins the game with five playing pieces, all of the same color. The playing pieces are placed on the board in such a way that each piece occupies one of the sixty small triangular areas 31 and 33 defined on the playing board. In a manner presently to the described each player then takes turns moving his pieces one space at a time in an effort to capture the pieces of his opponents. When a playing piece is captured, it is removed from the game board. When all of a given player's pieces are removed from the game board, he is out of the game. The last player to stay in the game is declared the winner.

Figure 4A:
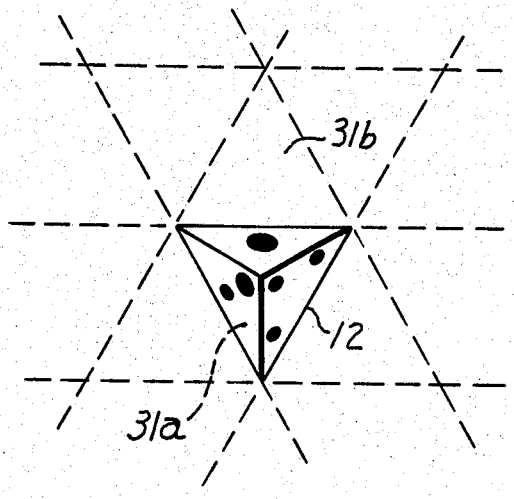
FIGS. 4A through 4D are generally diagramatic views illustrating the three types of movements possible with a game piece when playing one variation of the game.
Figure 4B:
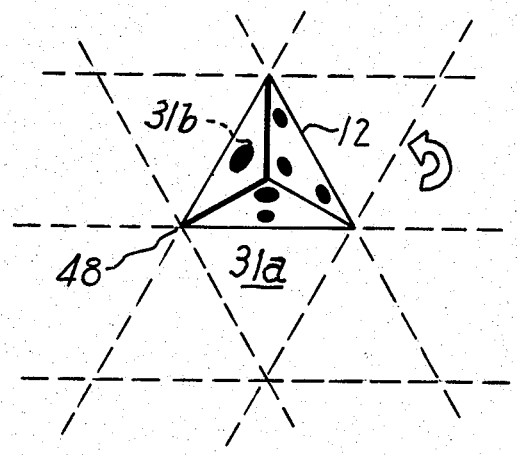
Figure 4C:
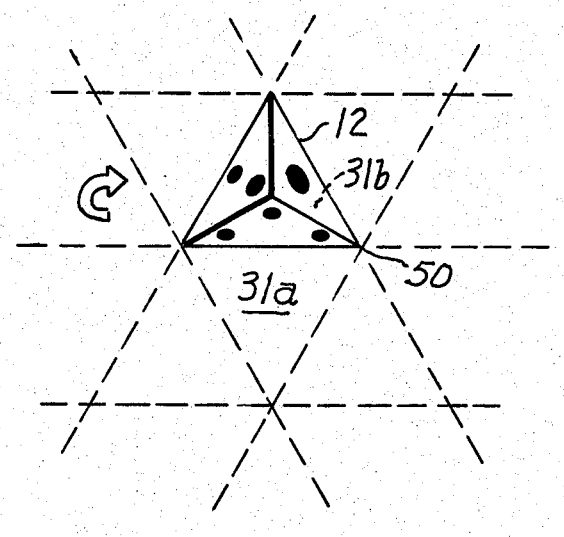
Figure 4D:
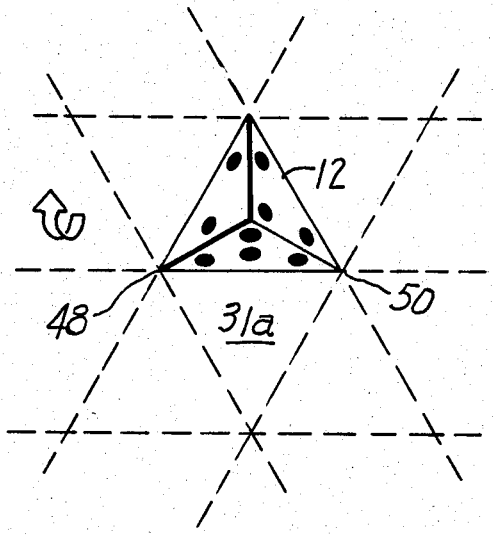

Turning now to FIGS. 4A through 4D, one possible mode of movement of the playing pieces 12 is there illustrated. FIG. 4A shows the playing piece 12, positioned on a matching triangular area identified in FIG. 4A by the numeral 31*a*. The piece 12 may move onto any one of the adjacent triangular areas (shown in dotted lines). The playing pieces may move onto the next adjoining area in any one of three ways, namely, by rotating the piece counter clockwise, by rotating the piece clockwise, or by flipping the piece over. For example, if the playing piece 12 is to move onto section 31*b*, it could rotate counter clockwise, pivoting around point 48 (FIG. 4B). In the second method of movement, playing piece 12 could rotate clockwise, pivoting around point 50 (FIG. 4C). Finally, as illustrated in FIG. 4D, playing piece 12 could flip over along the edge defined between point 48 and 50. By examining FIGS. 4A through 4D carefully, it is apparent that each mode of movement provides a different orientation of the piece with respect to the three exposed faces and the one hidden face of the playing piece. These differences in orientation and exposure provide the opportunity for challenging, strategic play.

Figure 5A:
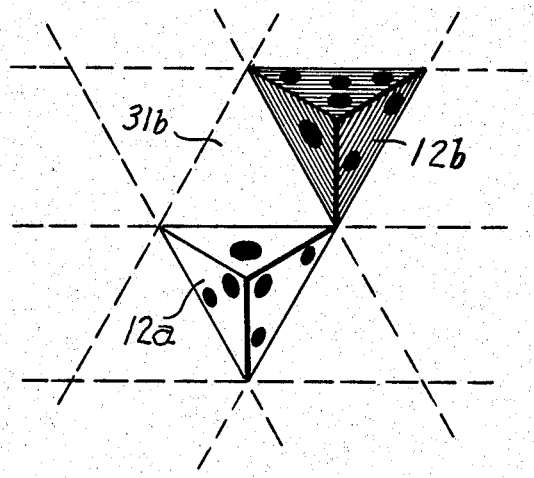
FIG. 5A through 5C are generally diagramatic views illustrating one method for capturing an opponent's playing piece while playing one variation of the game.
Figure 5B:
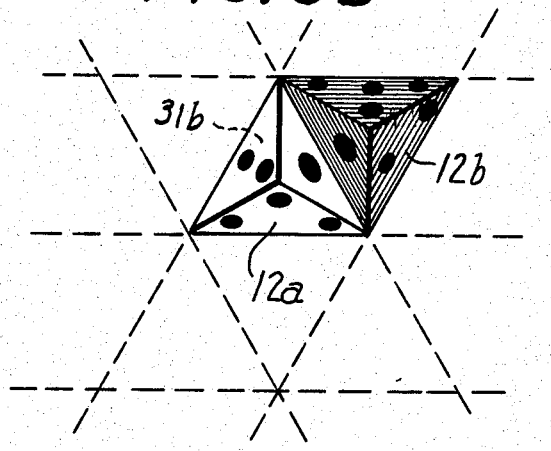
Figure 5C:
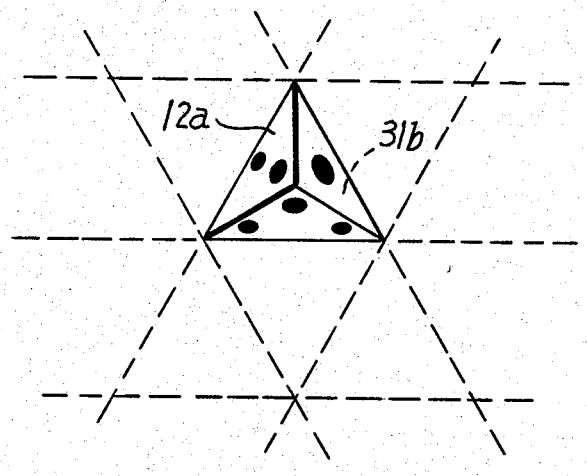

Referring now to FIGS. 5A through 5C, one method of capturing an opponent's piece is there illustrated. As with chess and checkers, the primary object of the game of the embodiment of the invention shown in the drawings is to capture, or take, the opponents pieces. This is done when a playing piece moves onto one of the three triangular areas 31 or 33 adjacent to an opponents playing pieces and the two adjacent faces both have the same surface indicia. Of course, the move must be accomplished in one of the three modes previously described and illustrated in FIGS. 4A through 4D.

A typical move and capture is illustrated in FIGS. 5A through 5C. In FIG. 5A, the next move is that of the white piece 12*a*. The obvious move is for playing piece 12*a* to rotate clockwise onto space 31*b*, thus matching the single dot faces of both the white piece and the opponent's shaded piece 12*b* (FIG. 5B). The shaded piece is thusly captured and removed from the board (FIG. 5C). It is to be noted that in the aforementioned example, if the move had been that of the shaded piece 12*b*, piece 12*b* could have been rotated counter clockwise onto space 31*b* and likewise have captured the white piece 12*a*.

A highly important and novel feature of the present invention is the fact that the game board 14 has a dual function, namely that of providing a surface upon which the game is played and also providing a unique tetrahedral shaped container, or box, adapted to hold the instructions and all of the playing pieces when the game is in transit, or in storage. Referring to FIGS. 3A through 3H, the step by step procedure for folding the board into the tetrahedral shaped package is there illustrated. So as to better illustrate the procedure, in these figures, the playing surface of the board is shown as white, while the reverse side is shown shaded.

Figure 3A:
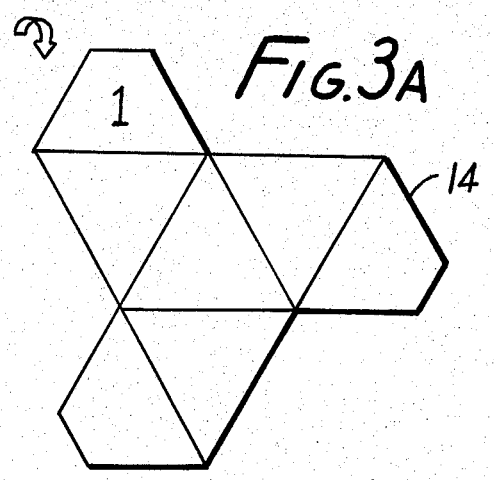
FIGS. 3A through 3H are generally diagramatic views illustrating how the game board shown in FIG. 1 is folded to provide a container for the game pieces.
Figure 3B:
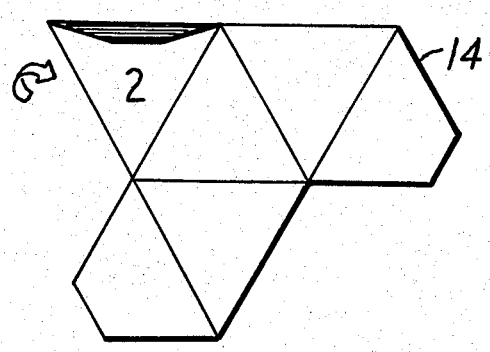
Figure 3C:
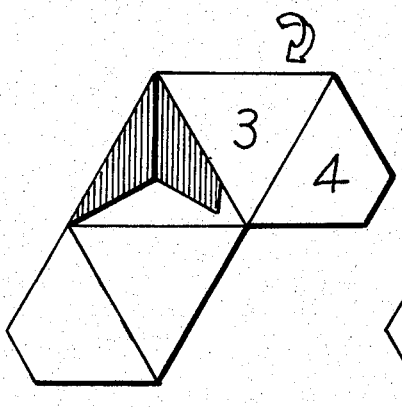
Figure 3D:
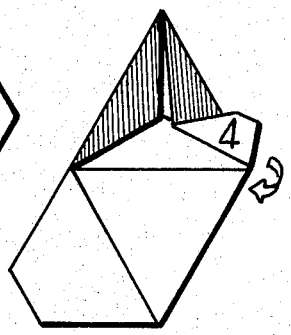
Figure 3E:
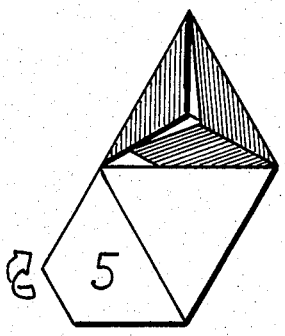
Figure 3F:
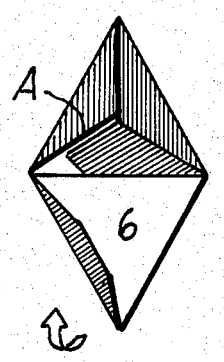
Figure 3G:
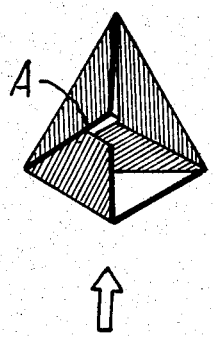
Figure 3H:
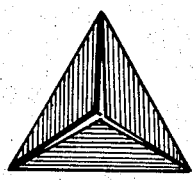

The first step, as illustrated in FIG. 3A, is to fold up trapazoidal panel 1 in the manner shown in FIG. 3B. Next triangular panel 2 is folded up until panel 1 touches the inside edge of panel 3 forming an arch-like construction of the character illustrated in FIG. 3C. Triangular panel 3 is then folded up, overlapping panel 1, thus forming an open tetrahedral box of the character shown in FIG. 3D. At this point, the playing pieces and instructions can be placed into the structure thus formed. Next, trapazoidal panel 4 is folded over the opening, closing the tetrahedral box in the manner illustrated in FIG. 3E. Trapazoidal panel 5 is then folded up (FIG. 3F) and, as triangular panel 6 is lifted up, panel 5 is inserted into the slot A formed by panels 2 and 4 (FIG. 3G). As panel 5 is pushed into slot A, the tetrahedral box is closed and the packaging structure completed (FIG. 3H).

The unique design of the container of the invention is such that the container will stay closed without any adhesives or fasteners. The container can be easily opened by gently pulling on any two triangular panels which permits it to be folded into the planar configuration shown in FIG. 1. At such time as the game is to be moved or placed into storage, the game board can once again be folded in the manner thus described to provide the novel compact and attractive packaging container for the game pieces and the game instructions. By designing the game board so that it can function as a package for the pieces, the cost of manufacturing the game is substantially reduced and the unique tetrahedral shape of the box or container provides an attractive and unique marketing feature, since the tetrahedral shape of the container is the same as that of the playing pieces, the container itself provides an easily recognizable and unique design which functions as a powerful marketing tool.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A board game comprising:

(a) a game board having a generally planar surface divided by line markings into:

(1) four triangularly shaped areas of equal size, each of said triangularly shaped areas being divided by line markings into a plurality of smaller areas; and (2) three trapazoidal shaped areas of equal size, each having one side thereof co-extensive with one side of one of said triangularly shaped areas, each of said trapazoidal shaped areas being divided by line markings into a plurality of smaller areas; and (b) a plurality of playing pieces, each having at least one face provided with distinctive markings said face being of a size and shape corresponding to said smaller areas of said triangularly and trapazoidal shaped areas.

2. A board game as defined in claim 1 in which each of said four triangularly shaped areas is divided by line markings into nine triangularly shaped smaller areas of equal size and in which each of said three trapazoidal shaped areas is divided by line markings into eight triangularly shaped smaller areas of equal size.

3. A board game as defined in claim 2 in which each of said playing pieces is tetrahedral in sahpe having faces of a size and shape equal to said triangularly shaped smaller areas.

4. A board game as defined in claim 3 in which each face of each of said playing pieces is provided with identifying indicia.

5. A board game as defined in claim 4 in which said identifying indicia on said faces of said playing pieces comprises respectively one, two, three and four dots.

6. A board game as defined in claim 1 in which said triangularly shaped and trapazoidal shaped areas of said game board comprise separate panels, said panels being foldably interconnected whereby said game board can be folded into a tetrahedral shaped container.

* * * * *